United States Patent [19]

Yoshida et al.

[11] 4,156,500

[45] May 29, 1979

[54] METHOD AND APPARATUS FOR PRODUCING COPPER CLAD STEEL WIRE

[75] Inventors: Shigeaki Yoshida, Itami; Susumu Ihara; Koichi Nishimune, both of Osaka, all of Japan

[73] Assignee: Sumitomo Electric Industries, Ltd., Osaka, Japan

[21] Appl. No.: 801,978

[22] Filed: May 31, 1977

[30] Foreign Application Priority Data

Jun. 2, 1976 [JP] Japan ..... 51-64327

[51] Int. Cl.[2] ..... B21D 39/04; H01B 13/22

[52] U.S. Cl. ..... 228/130; 228/156; 228/193

[58] Field of Search ..... 148/12 B, 11.5 Q, 12 R; 228/130, 148, 231, 17, 156, 193; 72/286

[56] References Cited

U.S. PATENT DOCUMENTS

| | | | |
|---|---|---|---|
| 3,154,846 | 11/1967 | Alexander | 228/156 X |
| 3,449,821 | 6/1969 | Vansteenkiste | 228/156 X |
| 3,630,057 | 12/1971 | Strohmeier | 72/286 X |
| 3,714,701 | 2/1973 | Dion et al. | 228/130 |
| 3,874,076 | 4/1975 | Tsukamoto et al. | 228/156 X |
| 3,894,675 | 7/1975 | Klebl et al. | 228/130 |
| 3,952,571 | 4/1976 | Yokota et al. | 72/286 X |

*Primary Examiner*—C. W. Lanham
*Assistant Examiner*—K. J. Ramsey
*Attorney, Agent, or Firm*—Sughrue, Rothwell, Mion, Zinn and Macpeak

[57] ABSTRACT

A method of producing a copper clad steel wire, which comprises the steps of preparing a 5 to 15 mm diameter steel rod and a 21 to 66.7 mm width copper tape; continuously supplying the steel rod and the copper tape separately and cleaning the surfaces thereof; forming the copper tape in tubular form such that the copper tape can cover the steel rod while supplying the steel rod and the copper tape in parallel, and welding the edges of the copper tape in a non-oxidizing atmosphere; sinking the tubular copper tape sufficiently for the copper tape to substantially come into contact with the steel rod to form a copper clad steel rod; cold-drawing the copper clad steel rod and/or hot working the clad rod at a temperature of 400° to 800° C. to reduce its cross-sectional area by more than 20%; and then annealing the copper clad steel rod at a temperature of 300° to 1050° C.

2 Claims, 4 Drawing Figures

METHOD AND APPARATUS FOR PRODUCING COPPER CLAD STEEL WIRE

BACKGROUND OF THE INVENTION

The present invention relates to a method and an apparatus for producing a copper clad steel wire.

Certain methods are already known for producing a copper clad steel wire such as by billet casting, electroplating, and tube sinking. Billet casting is a method of pouring molten copper around a steel rod to form an ingot and then hot rolling the formed ingot to produce a copper cladded steel rod. This method requires a large sized hot rolling mill and cannot continuously produce copper clad steel wire, which results in added expensive wire. Electro-plating is a method of plating a steel rod with copper. This method requires a plating liquid composed mainly of NaCN or CuCN which would cause pollution, and also hardly form a plated layer of a uniform thickness which results in a low quality copper clad steel wire. Tube sinking is a method of drawing a copper tube inserted therein with a steel rod. This method cannot continuously produce the copper clad steel wire and is low in productivity.

SUMMARY OF THE INVENTION

It is, therefore, an object of the present invention to provide an improved method and an apparatus for producing a copper clad steel wire, which is free from the above-mentioned and other disadvantages found in the conventional methods and apparatus and which is high in productivity and economical.

Another object of the present invention is to apply an improved method of tube forming, seam welding, and tube sinking for producing an inexpensive copper clad steel wire.

Still another object of the present invention is to provide a sufficient metallurgical bonding on the interface between the copper and steel of the clad rod to thereby producing a high quality copper clad steel wire.

A further object of the present invention is to provide an improved method which can continuously produce a copper clad steel wire without the problem of pollution.

The present invention comprises the steps of preparing a 5 to 15 mm diameter steel rod and a 21 to 66.7 mm width copper tape; continuously supplying and surface-cleaning the steel rod and the copper tape separately, forming the copper tape in tubular form such that the copper tape can cover the steel rod while supplying the steel rod and the copper tape in parallel; welding the edges of the copper tape in a non-oxidizing atmosphere; tube sinking the tubular copper tape sufficiently it to substantially contact with steel rod to form a copper clad steel rod; cold-drawing the copper clad steel rod and/or hot working it at a temperature of 400° to 800° C. to reduce its cross-sectional area by more than 20%; and then annealing the copper clad steel rod at a temperature of 300° to 1050° C.

In the above process, the copper tape may be formed in tubular form by means of forming rolls having grooves along which the steel rod is supplied.

DETAILED DESCRIPTION OF THE INVENTION

Figure 1:
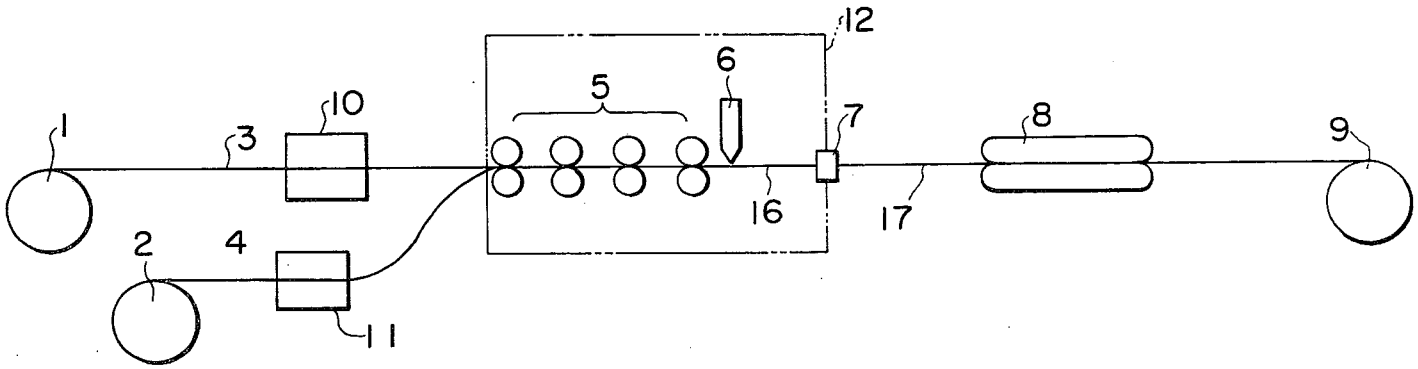
FIG. 1 is a schematic view showing one embodiment of the present invention.

Referring now to the drawings, and initially to FIG. 1 thereof, there is illustrated one embodiment of a copper clad steel wire producing apparatus according to the present invention. A steel rod 3 is fed from a steel rod supply 1, straightened, and mechanically descaled such as by degreasing and wire brushing through a surface cleaning machine 10, and then is introduced into a tube forming mill 5. On the other hand, a copper tape 4 is fed from a tape supply spool 2, mechanically descaled such as by degreasing and wire brushing through a surface cleaning machine 11, and then introduced into the tube forming mill 5 together with the steel rod 3. The above-mentioned processes may be made in a manner well known in the art.

Upon the introduction of the steel rod 3 and the copper tape 4 into the tube forming mill 5, they are longitudinally put together. In the tube forming mill 5, the copper tape 4 is bent widthwise in tubular form to cover the steel wire 3 and then the edges of the copper tape 4 is welded by a welder 6 within a shield room 12 charged with argin gas or a mixture of argon gas and hydrogen gas; that is in a non-oxidizing atmosphere. The welder 6 may comprise a well known means such as TIG welding machine or high frequency induction welding machine.

The steel rod 3 has an extremely high rigidity and if the back tension thereof is small during the copper tube forming, a twist may be introduced thereto, which spoils the formability of the copper tape 4. On the other hand, when a back tension is applied to prevent the occurrence of the twist e.g., by providing a braking device on the steel rod supply, vibrations are produced, resulting in an unstable seam welding and production of blow holes.

Figure 3A:
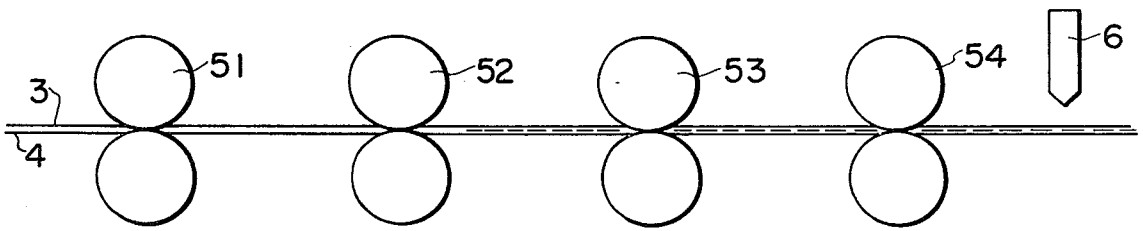
FIG. 3A is a side view of a tube forming machine used in the present invention.
Figure 3B:
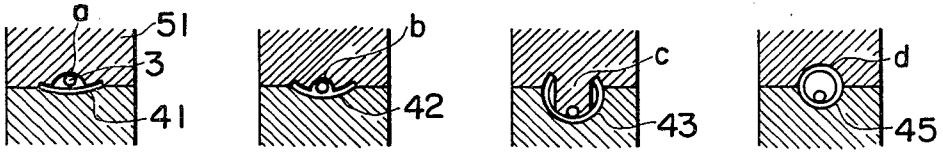
FIG. 3B shows sectional views of the tube forming machine.

The first feature of the present invention is that the tube forming mill 5 comprises at least one forming roll pair, one of the forming rolls for pressing the inner surface of the copper tube being formed with a groove for receiving the steel rod to thereby eliminate the twists in the steel rod without the application of back tension. This avoids above-mentioned disadvantages and permits stable tube forming and welding processes. FIGS. 3A and 3B illustrate such an arrangement in which first and second forming rolls 51 and 52 have grooves a and b for receiving the steel rod 3 introduced into the tube forming mill 5 together with the copper tape 4 and third and fourth forming rolls 53 and 54 function to form the copper tape 4 in tubular form so as to cover the steel rod 3 with the copper tape 4. Although the tube forming mill 5 is illustrated in FIGS. 3A and 3B as having four pair of forming rolls, the number of the forming roll pairs is not limited to this number.

After the welding process is completed, the composite rod 16 is introduced into a tube sinking die 7 which serves to sink the copper tape 4 substantially into contact with the steel rod 3 to form copper clad steel rod 17. Thereafter, the copper clad steel rod 17 is cooled and wound around a take-up drum 9.

The steel rod 3 used in the present invention has a 5 to 15 mm diameter and has a carbon content of 0.06% to 0.85%. If the diameter is less than 5 mm, the productivity of the steel rod is reduced. If the diameter is more than 15 mm, the handling of the steel rod becomes difficult and a large sized drawing machine is required. On the other hand, the copper tape 4 is made of electric tough-pitch copper (EPCu) or oxygen-free copper (OFCu) having width of 21.0 to 66.7 mm. In addition, the steel rod 3 and the copper tape 4 should satisfy the following relation:

$$0.05 \leqq \frac{2rt + t^2}{r^2 + 2rt + t^2} \leqq 0.5$$

where r is the radius of the steel rod 3 and t is the thickness of the copper tape 4.

If the ratio is less than 0.05 (5% Cu), the forming and welding processes become difficult and the drawability after the tube sinking process is reduced. If the ratio is more than 0.5 (50% Cu), the efficiency of the welding process is extremely reduced and the manufacture cost is increased.

In the present invention, the copper cladded steel rod 17 is further cold-worked and annealed in order to improve the bending property between the copper tape and the steel rod in the composite rod. That is, the composite rod is introduced a drawing machine where it is cold-worked at a reduction in cross-sectional area of more than 20% and then is annealed at a temperature of 300° to 1050° C. to soften the composite rod.

Figure 2:
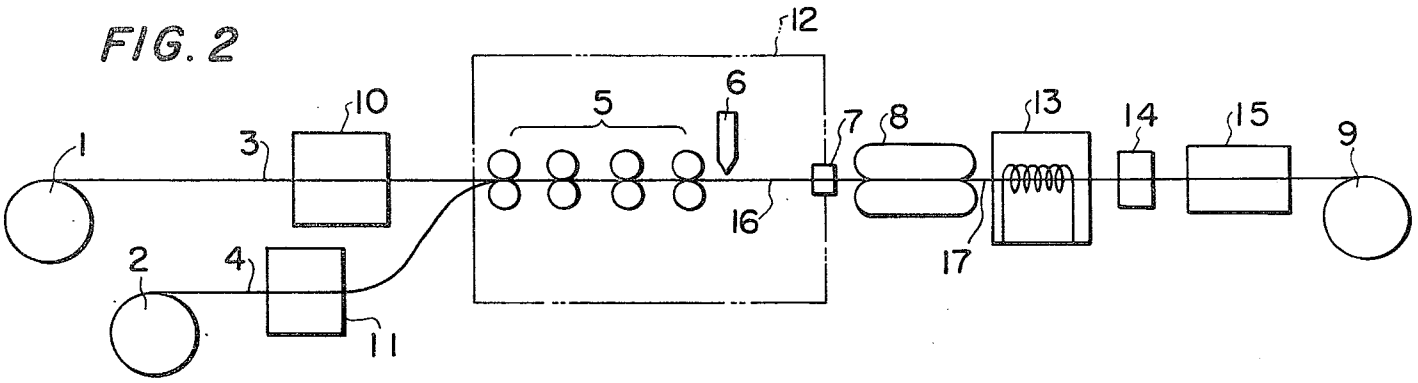
FIG. 2 is a schematic view showing an alternative embodiment of the present invention.

FIG. 2 illustrates an alternative embodiment of a copper clad steel wire producing apparatus in which corresponding parts to those in FIG. 1 are designated by the like reference numerals. In this embodiment, the composite rod is hot-worked at a reduction in cross-sectional area of more than 20% and at a temperature of 400° to 800° C. instead of the cold-working and the annealing. This composite rod may be cold-drawn and/or annealed if necessary.

The present invention will be more clearly understood by referring to the following Examples.

EXAMPLE 1

The apparatus as illustrated in FIG. 1 was used in this Example. A 8.5 mm diameter steel rod having a 0.13% carbon content was annealed, washed in an acid, and wire-brushed. A 38 mm width and 1 mm thickness annealed copper tape was degreased by alkali-electrolyte, washed in water, dried, and wire-brushed. Then, the steel rod and the copper tape were fed into the tube forming mill 5 contained in the shield room 12 through which argon gas is flown at 10 l/min and a 12 mm diameter composite rod was obtained. Thereafter, the edges of the copper tape were welded at a welding speed of 10 m/min by a normal TIG welding and then the copper tube was sunk by a hard metal die 7 of such as WC-alloy having a diameter of 9.5 mm and a half die angle of 25° such that the copper tape is brought substantially into contact with the steel rod. The resulting copper clad rod was wound around the takeup drum 9. Thereby, a copper clad steel wire having a diameter of 9.5 mm and an about 20% fractional area of copper was obtained.

Further, the copper clad steel wire was drawn by a normal drawing machine and then was cold-worked at various area reductions and annealed at various temperatures. As a result, the copper clad steel wire cold-worked at an area reduction in the range of 20% to 70% and annealed at a temperature in the range of 300° C. to 1050° C. has proven satisfactory in the bonding between the copper tape and the steel rod. In addition, it has been found that a 70% area reduction, clad rod annealed at a temperature of 800° C. to 1000° C. for five hours exhibits a most suitable bonding and is free from wire breakage during the following drawing process. It has been also found that an optimum relation between the copper tape and the steel rod is $$0.10 \leqq \frac{2rt + t^2}{t^2 + 2rt + r^2} \leqq 0.30$$

EXAMPLE 2

The apparatus as illustrated in FIG. 2 was used in this Example. A copper cladded steel rod 17 produced in the same manner as described in Example 1 was heated at a temperature 400° to 800° C. within a furnace 13 (see FIG. 2) and then was hot drawn at an area reduction of 10% to 30% by a drawing die. The resulting copper clad steel wire was excellent in the bonding between the steel rod and the copper tape and was free from wire breakage during the following drawing process.

It is, therefore, apparent that there has been provided, in accordance with the present invention, an apparatus and methods which can continuously produce a copper clad steel wire without the occurrence of pollution and which is high in productivity to permit the reduction of the manufacture cost of copper clad steel wires.

What is claimed is:

1. A method of producing a copper clad steel wire, comprising the steps of (a) preparing a 5 to 15 mm diameter steel rod and a 21 to 66.7 mm width copper tape, the steel rod and the copper tape having a relation expressed by $$0.05 \leqq \frac{2rt + t^2}{r^2 + 2rt + t^2} \leqq 0.5$$

where r is the radius of the steel rod and t is the thickness of the copper tape;

(b) continuously supplying and surface-cleaning the steel rod and the copper tape separately, forming the copper tape in tubular form such that the copper tape can cover the steel rod, and then welding the seam of the copper tape in a non-oxidizing atmosphere;

(c) sinking the tubular copper tape sufficiently for the copper tape to substantially come into contact with the steel rod to form a copper clad steel rod; and (d) cold drawing the copper clad steel rod and then annealing the copper clad steel rod at a temperature of 300° to 1050°, the temperature of the clad wire being maintained below 300° at all times until said annealing step, whereby bonding of said copper to said rod is achieved by said annealing step.

2. A copper cladded steel wire producing method as set forth in claim 1, further comprising the step of cold drawing the copper clad steel rod and/or further annealing the copper clad steel rod after the annealing thereof.

* * * * *